US006402923B1

(12) United States Patent
Mayer et al.

(10) Patent No.: US 6,402,923 B1
(45) Date of Patent: Jun. 11, 2002

(54) METHOD AND APPARATUS FOR UNIFORM ELECTROPLATING OF INTEGRATED CIRCUITS USING A VARIABLE FIELD SHAPING ELEMENT

(76) Inventors: Steven T. Mayer, 17867 Sundown Ct., Lake Oswego, OR (US) 97034; Richard Hill, 187 Heather Dr., San Jose, CA (US) 94027; Alain Harrus, 517 Patricia La., Palo Alto, CA (US) 94303; Evan Patton, 2972 SW. Collins Ct., Portland, OR (US) 97219; Robert Contolini, 5575 Suncreek Dr., Lake Oswego, OR (US) 97035; Steve Taatjes, 1331 High Touch St., West Linn, OR (US) 97068; Jon Reid, 420 SW. Madrona La., Sherwood, OR (US) 97140

( * ) Notice: Subject to any disclaimer, the term of this patent is extended or adjusted under 35 U.S.C. 154(b) by 0 days.

(21) Appl. No.: 09/537,467

(22) Filed: Mar. 27, 2000

(51) Int. Cl.[7] ..... C25D 5/00

(52) U.S. Cl. ..... 205/96; 204/224 R; 204/297.05; 204/DIG. 7; 204/118; 204/123; 204/157

(58) Field of Search ..... 204/224 R, 297.05, 204/DIG. 7, 229.8; 205/122, 123, 125, 96, 97, 118, 157

(56) References Cited

U.S. PATENT DOCUMENTS

| | | | | | |
|---|---|---|---|---|---|
| 3,437,578 | A | * | 4/1969 | Gibbs et al. | 204/224 R |
| 4,469,566 | A | | 9/1984 | Wray | |
| 5,804,052 | A | | 9/1998 | Schneider | |
| 6,033,540 | A | * | 5/2000 | Kosaki et al. | 204/284 |
| 6,132,805 | A | * | 10/2000 | Moslehi | 427/248.1 |
| 6,179,983 | B1 | * | 1/2001 | Reid et al. | 205/96 |

* cited by examiner

*Primary Examiner*—Donald R. Valentine
*Assistant Examiner*—Wesley A. Nicolas
(74) *Attorney, Agent, or Firm*—Thomas Swenson; Lathrop & Gage, L.C.

(57) ABSTRACT

An electrochemical reactor is used to electrofill damascene architecture for integrated circuits. A shield is used to screen the applied field during electroplating operations to compensate for potential drop along the radius of a wafer. The shield establishes an inverse potential drop in the electrolytic fluid to overcome the resistance of a thin film seed layer of copper on the wafer.

25 Claims, 4 Drawing Sheets

METHOD AND APPARATUS FOR UNIFORM ELECTROPLATING OF INTEGRATED CIRCUITS USING A VARIABLE FIELD SHAPING ELEMENT

BACKGROUND OF THE INVENTION

1. Field of the Invention

The present invention pertains to the field of electrochemical reactors and, particularly, to their use in electroplating metal films on wafers for use in making integrated circuits. More specifically, a specialized mask or shield is used to vary the electric field at the wafer during the electroplating operation to increase a uniformity of thickness in the layer being deposited.

2. Statement of the Problem

Integrated circuits are formed on wafers by well known processes and materials. These processes typically include the deposition of thin film layers by sputtering, metal-organic decomposition, chemical vapor deposition, plasma vapor deposition, and other techniques. These layers are processed by a variety of well known etching technologies and subsequent deposition steps to provide a completed integrated circuit.

A crucial component of integrated circuits is the wiring or metalization layer that interconnects the individual circuits. Conventional metal deposition techniques include physical vapor deposition, e.g., sputtering and evaporation, and chemical vapor deposition techniques. Some integrated circuit manufacturers are investigating electrodeposition techniques to deposit primary conductor films on semiconductor substrates.

Wiring layers have traditionally been made of aluminum and a plurality of other metal layers that are compatible with the aluminum. In 1997, IBM introduced technology that facilitated a transition from aluminum to copper wiring layers. This technology has demanded corresponding changes in process architecture towards damascene and dual damascene architecture, as well as new process technologies.

Copper damascene circuits are produced by initially forming trenches and other embedded features in a wafer, as needed for circuit architecture. These trenches and embedded features are formed by conventional photolithographic processes. A barrier layer, e.g., of tantalum or tantalum nitride, is next deposited. An initial seed or strike layer of copper about 125 nm thick is then deposited by a conventional vapor deposition technique. Thickness of this seed layer may vary and it is typically a thin conductive layer of copper or tungsten. The seed layer is used as a base layer to conduct current for electroplating thicker films. The seed layer functions as the cathode of the electroplating cell as it carries electrical current between the edge of the wafer and the center of the wafer including fill of embedded structures, trenches or vias. The final electrodeposited thick film should completely fill the embedded structures, and it should have a uniform thickness across the surface of the wafer.

Generally, in electroplating processes, the thickness profile of the deposited metal is controlled to be as uniform as possible. This uniform profile is advantageous in subsequent etchback or polish removal steps. Prior art electroplating techniques are susceptible to thickness irregularities. Contributing factors to these irregularities are recognized to include the size and shape of the electroplating cell, electrolyte depletion effects, hot edge effects and the terminal effect and feature density.

The seed layer initially has a significant resistance radially from the edge to the center of the wafer because the seed layer is initially very thin. This resistance causes a corresponding potential drop from the edge where electrical contact is made to the center of the wafer. These effects are reported in L. A. Gochberg, "Modeling of Uniformity and 300-mm Scale-up in a Copper Electroplating Tool", *Proceedings of the Electrochemical Society* (Fall 1999, Honolulu Hawaii); and E. K. Broadbent, E. J. McInerney, L. C. Gochberg, and R. L. Jackson, "Experimental and Analytical Study of Seed Layer Resistance for Copper Damascene Electroplating", *Vac. Sci. & Technol.* B17, 2584 (November/December 1999). Thus, the seed layer has a nonuniform initial potential that is more negative at the edge of the wafer. The associated deposition rate tends to be greater at the wafer edge relative to the interior of the wafer. This effect is known as the 'terminal effect.'

One solution to the end effect would be to deposit a thicker seed layer having less potential drop from the center of the wafer to the edge, however, thickness uniformity of the final metal layer is also impaired if the seed layer is too thick. Another alternative is to have a seed layer that is thicker in the center than at the edge. However, necking of the seed layer in the thicker area may cause filling problems. FIG. 1 shows a prior art seed layer 100 made of copper formed atop barrier layer 102 and a dielectric wafer 104. A trench or via 106 has been cut into wafer 104. Seed layer 100 thickens in mouth region 108 with thinning towards bottom region 110. The thickness of seed layer 100 is a limiting factor on the ability of this layer to conduct electricity in the amounts that are required for electroplating operations. Thus, during electrodeposition, the relatively thick area of seed layer 100 at mouth region 108 can grow more rapidly than does the relatively thin bottom region 110 with the resultant formation of a void or pocket in the area of bottom region 110 once mouth region 108 is sealed. This is particularly true when bottom-up filling chemistries are not employed or other mitigating factors prevent bottom-up filling chemistries from producing void-free features.

FIG. 2 shows an ideal seed layer 200 made of copper formed atop barrier layer 202 and a dielectric wafer 204. A trench or via 206 has been cut into wafer 204. Ideal seed layer 200 has three important properties:

1. Good uniformity in thickness and quality across the entire horizontal surface 208 of wafer 204;
2. Excellent step coverage exists in via 206 consisting of continuous conformal amounts of metal deposited onto the sidewalls; and
3. In contrast to FIG. 1, there is minimal necking in the mouth region 210. It is difficult or impossible to obtain these properties in seed layers having a thickness greater than about 120 nm to 130 nm over features smaller than 0.15 $\mu$m.

The electroplating of a thicker copper layer should begin with a layer that approximates the ideal seed layer 200 shown in FIG. 2. The electroplating process will exacerbate any problems that exist with the initial seed layer due to increased deposition rates in thicker areas that are better able to conduct electricity. The electroplating process must be properly controlled or else thickness of the layer will not be uniform, there will develop poor step coverage, and necking of embedded structures can lead to the formation of gaps of pockets in the embedded structure.

A significant part of the electroplating process is the electrofilling of embedded structures. The ability to electrofill small, high aspect ratio features without voids or seams is a function of many parameters. These parameters include the plating chemistry; the shape of the feature including the width, depth, and pattern density; local seed layer thickness; local seed layer coverage; and local plating current. Due to the requisite thinness of the seed layers, a significant potential difference exists between the metal phase potential at the center of a wafer and the metal phase potential at the edges of a wafer. Poor sidewall coverage in embedded structures, such as trench 106 in FIG. 1, develops higher average resistivity for current traveling in a direction that is normal to the trench. See S. Meyer et al., "Integration of Copper PVD and Electroplating for Damascene Feature Electrofilling" *Proceeding of Electrochemical Society, Session on Interconnects & Contact Metallization Symposium* (Fall 1999, Honolulu Hawaii). Due to these factors in combination, there is a finite range of current densities over which electrofilling can be performed. If the electrical resistivity is too large in the metal phase, it may be impossible to fill a structure at the wafer center without using the present invention.

Manufacturing demands are trending towards circumstances that operate against the goal of global electrofilling of embedded structures and thickness uniformity. Industry trends are towards thinner seed films, larger diameter wafers, increased pattern densities, and increased aspect ratio of circuit features. The trend towards thinner seed layers is required to compensate for an increased percentage of necking in smaller structures, as compared to larger ones. For example, FIG. 3 shows a comparison between etched versus seeded features for a Novellus Systems Inc. HCM PVD process. A 45° line is drawn to show no necking, but the data shows necking as the seeded feature width rolls downward in the range from 0.3 $\mu$m to 0.15 $\mu$m.

Regarding the trend towards larger diameter wafers, it is generally understood that the deposition rate, as measured by layer thickness, can be maintained by scaling total current through the electrochemical reactor in proportion to the increased surface area of the larger wafer. Thus, a 300 mm wafer requires 2.25 times more current than does a 200 mm wafer. Electroplating operations are normally performed by using a clamshell wafer holder that contacts the wafer only at its outer radius. Due to this mechanical arrangement, the total resistance from the edge of the wafer to the center of the wafer is independent of the radius. Nevertheless, with the higher applied current at the edge of the larger wafer, which is required to maintain the same current density for process uniformity, the total potential drop from the edge to the center of the wafer is greater for the larger diameter wafer. This circumstance leads to an increased rate of deposition (layer thickness) with radius. While the problem of increasing deposition rate with radius exists for all wafers, it is exacerbated in the case of larger wafers. At sufficiently large wafer sizes, the difference in current density at the center versus the edge will lead to incomplete fill at one of those locations.

U.S. Pat. No. 4,469,566 to Wray teaches electroplating of a paramagnetic layer with use of dual rotating masks each having aligned aperture slots. Each mask is closely aligned with a corresponding anode or cathode. The alternating field exposure provides a burst of nucleation energy followed by reduced energy for a curdling effect. The respective masks and the drive mechanism are incapable of varying the distance between each mask and its corresponding anode or cathode, and they also are incapable of varying the mask surface area of their corresponding anode or cathode.

U.S. Pat. No. 5,804,052 to Schneider teaches the use of rotating roller-shaped bipolar electrodes that roll without short circuit across the surface being treated in the manner of a wiper.

None of the aforementioned patents or articles overcome the special problems of electroplating metal films for use in integrated circuits or more generally, where the electrical resistance in an underlying conductive layer changes as the layer grows and where the deposited film thickness must be uniform. There exists a need to compensate the potential drop in the seed layer to facilitate uniform electroplating and electrofilling of metalization or wiring layers for integrated circuits.

Solution

The present invention overcomes the problems that are outlined above by providing a time variable field shaping element, i.e., a mask or shield, that is placed in the electrochemical reactor to compensate for the potential drop in the seed layer. The shield compensates for this potential drop in the seed layer by shaping an inverse resistance drop in the electrolyte to achieve a uniform current distribution.

Method and apparatus of the invention involves an electrochemical reactor having a variable field-shaping capability for use in electroplating of integrated circuits. The electrochemical reactor includes a reservoir that retains an electrolytic fluid. A cathode and an anode are disposed in the reservoir to provide an electrical pathway through the electrolytic fluid. A wafer-holder contracts one of the anode and the cathode. A selectively actuatable shield is positioned in the electrical pathway between the cathode and the anode for varying an electric field around the wafer-holder during electroplating operations.

The shield can have many forms. A mechanical iris may be used to change the size of the aperture or a strip having different sizes of apertures may be shifted to vary the size of aperture that is aligned with the wafer. The shield may be raised and lowered to vary a distance that separates the shield from the wafer. The wafer or the shield may be rotated to average field inconsistencies that are presented to the wafer. The shield may have a wedge shape that screens a portion of the wafer from an applied field as the wafer rotates. The shield may also be tilted to present more or less surface area for screening effect.

DETAILED DESCRIPTION OF THE PREFERRED EMBODIMENTS

Mechanical Iris Embodiment

Figure 4:
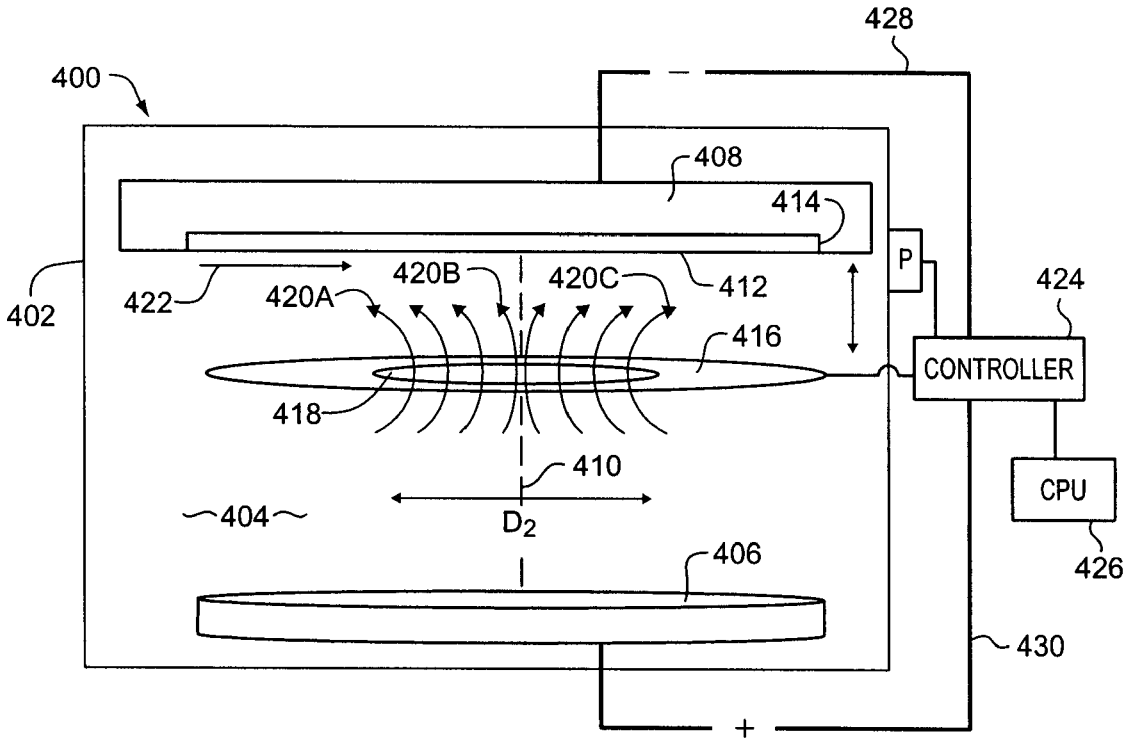
FIG. 4 depicts a first embodiment of an electrochemical reactor according to the present invention where the shield is constructed as a mechanical iris.

FIG.4 depicts an electrochemical reactor 400 according to a first embodiment of the present invention. A reservoir 402 contains a conventional electrolytic fluid or electroplating bath 404. An anode 406 and a cathode 408 establish an electrical pathway 410 through the electrolytic fluid 404. The anode is typically made of the metal being plated, which is compatible with the electrolytic fluid 404 and is preferably copper for purposes of the invention. It can also be composed of a nonreactive or dimensionally stable anode, such as Pt, Ti, or other materials known in the art. As shown in FIG. 4, cathode 408 is formed as a clamshell holding device that retains wafer 412 by placing the wafer in electrical contact with cathode-wafer holder 408 only at the outer radius 414 of wafer 412. The anode/wafer holder 408 also rotates as a turntable by the action of a mechanical drive mechanism M in preferred embodiments for the purpose of averaging field variances that are presented to the wafer 412 during electroplating operations. The concept of shielding a wafer during electrodeposition is also disclosed in application Ser. No. 08/968,814, which is incorporated by reference to the same extent as though fully disclosed herein.

Figure 1:
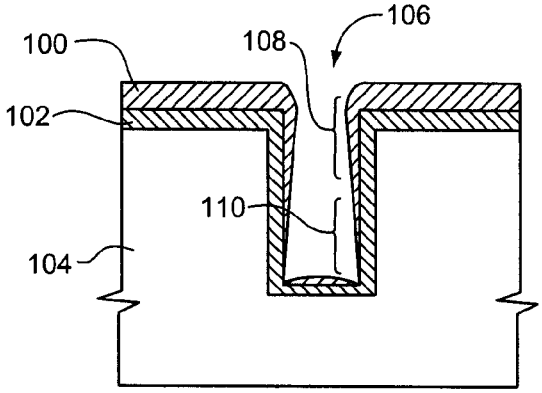
FIG. 1 PRIOR ART
FIG. 1 depicts a prior art seed layer deposited on a wafer to form an undesirable necked feature at the mouth of a trench.
Figure 2:
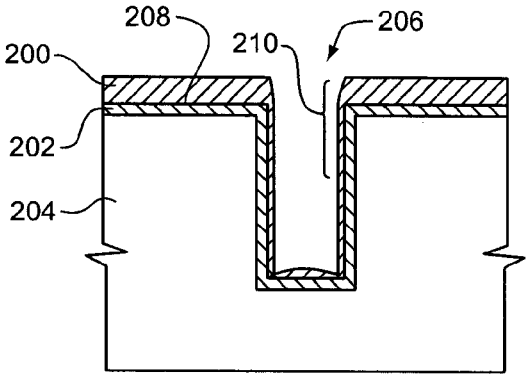
FIG. 2 PRIOR ART
FIG. 2 depicts an ideal seed layer that is deposited to provide uniform coverage across a trench feature, as well as on the surface of the wafer.
Figure 3:
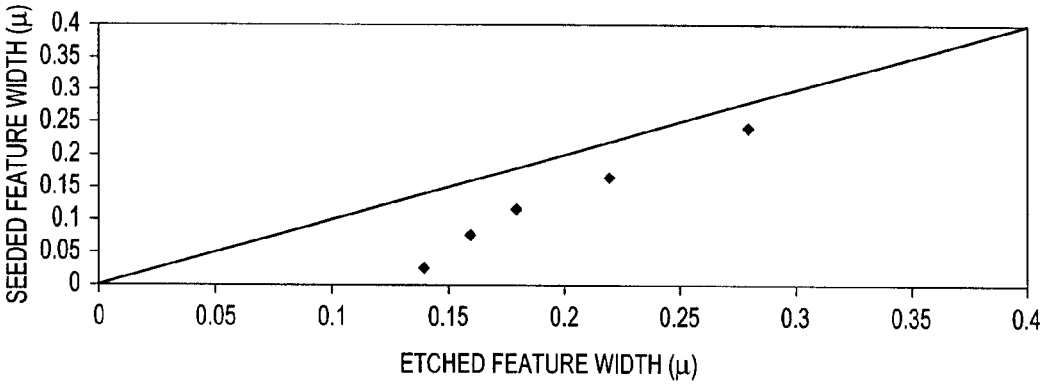
FIG. 3 PRIOR ART
FIG. 3 shows data from a HCM PVD process demonstrating rolloff in a comparison between etched feature width and seeded feature width that indicates necking as a percentage of feature width increases as the etched feature width decreases.

Wafer 412 may be any semiconducting or dielectric wafer, such as silicon, silicon-germanium, ruby, quartz, sapphire, and gallium arsenide. Prior to electroplating, wafer 412 is preferably a silicon wafer having a copper seed layer 200 atop a Ta or Ti nitride barrier layer 202 with embedded features 206, as shown in FIG. 2.

A mechanical shield 416 is placed in electrical pathway 410. This particular shield 416 presents a circular iris or aperture 418. The structural components for the manufacture of mechanical shield 414, as well as its method of operation, are known in the art of camera manufacturing where a plurality of overlapping elongated elements (not depicted in FIG. 4) are interconnected to form a substantially circular central opening that varies depending upon the azimuthal orientation of the respective elongated elements. Shield 416 is made of materials that resist attack by the electrolytic fluid 404. These materials are preferably high dielectrics or a composite material including a coating of a high dielectric to prevent electroplating of metal onto the shield 416 due to the induced variation in potential with position of the shield within the bath. Plastics may be used including polypropylene, polyethylene, and fluoro-polymers, especially polyvinylidine fluoride.

A plurality of field lines 420*a*, 420*b*, and 420*c* show the mechanism that shield 416 uses to compensate for the radial drop in potential across the surface of wafer 412 along radial vector 422. Due to the fact that shield 416 prevents the passage of current along electrical pathway 410 except through iris 418, the field lines 420*a*–420*c* curve towards outer radius 414 to provide an inverse potential drop in electrolytic fluid 404 compensating for the potential drop along radial vector 422. Thus, the current is concentrated at the center of the wafer, which is in vertical alignment with iris 418. The potential drop along radial vector 422 changes with time as the copper plating on wafer 412 increases in thickness. The increased thickness reduces the total potential drop in the copper following radial vector 422.

There is a corresponding need to move or change the shape of shield 416 in a continuous manner to offset the variable potential drop along radial vector 422. This movement can be accomplished by two mechanisms that are implemented by a controller 424 and a central processor 426. According to a first mechanism, controller 422 increases the diameter $D_2$ of iris 418 to provide a more direct route to the wafer with less curvature of field lines 420*a*–*c* along electrical pathway 410. According to a second mechanism, controller 424 injects a neutral pressurized gas from a source P into reservoir 402. Shield 416 contains an air bladder or trapped bubbles (not depicted in FIG. 4) that withstand a reduction in volume due to the increase in pressure. Shield 414 loses buoyancy and, consequently, falls relative to wafer 412 with an increase in dimension 425 separating wafer 412 from shield 416. The increase in dimension 425 requires field lines 420*a*–420*c* to bend less sharply before contacting wafer 412 with the corresponding effect of concentrating less current at the center of wafer 412. Alternatively, a mechanical drive mechanism (not depicted in FIG. 4) may be used to raise and lower shield 412 to vary the dimension 425 separating shield 416 from wafer 412.

The Electroplating Bath 404

The electroplating bath 404 is a conventional bath that typically contains the metal to be plated together with associated anions in an acidic solution. Copper electroplating is usually performed using a solution of $CuSO_4$ dissolved in an aqueous solution of sulfuric acid. In addition to these major constituents of the electroplating bath 404, it is common for the bath to contain several additives, which are any type of compound added to the plating bath to change the plating behavior. These additives are typically, but not exclusively, organic compounds that are added in low concentrations ranging from 20 ppm to 400 ppm.

Three types of electroplating bath additives are in common use, subject to design choice by those skilled in the art. Suppressor additives retard the plating reaction and increase the polarization of the cell. Typical suppressors are large molecules having a polar center such as an ionic end group, e.g., a surfactant. These molecules increase the surface polarization layerand prevent copper ion from readily adsorbing onto the surface. Thus, suppressors function as blockers. Suppressors cause the resistance of the surface to be very high in relation to the electroplating bath. Trace levels of chloride ion may be required for suppressors to be effective.

Accelerator additives are normally catalysts that accelerate the plating reaction. Accelerators may be rather small molecules that perhaps contain sulphur, and they need not be ionic. Accelerators adsorb onto the surface and increase the flow of current. Accelerators may occur not as the species directly added tot he electroplating bath, but as breakdown products of such molecules. In either case, the net effect of accelerators is to increase current flow and accelerate the reaction when such species are present or become present through chemical breakdown.

Levelers behave like suppressors but tend to be more electrochemically active (i.e., are more easily electrochemically transformed) than suppressors typically being consumed during electroplating. Levelers also tend to accelerate plating on depressed regions of the surface undergoing plating, thus, tending to level the plated surface.

Wedge Shield Embodiment

Figure 5:
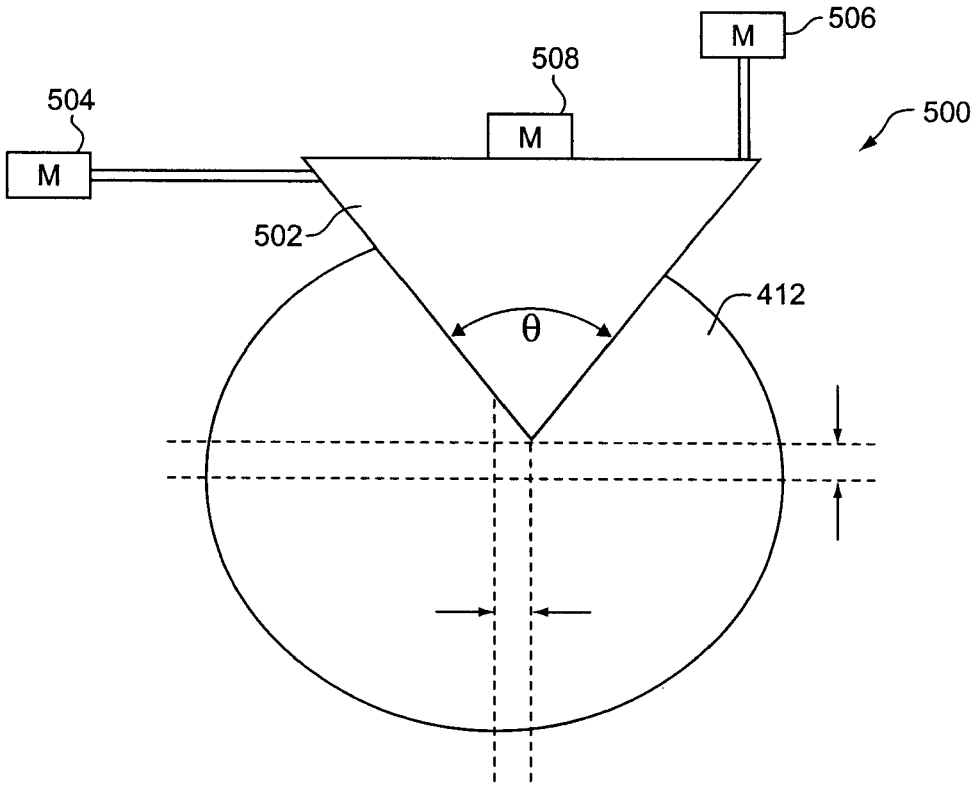
FIG. 5 depicts a second embodiment of an electrochemical reactor according to the present invention where the shield is constructed as a wedge having a three dimensional range of motion.

FIG. 5 depicts a second embodiment of the invention including an electrochemical reactor 500. Electrochemical reactor 500 is identical to electrochemical reactor 400, except for differences between a wedge-shaped shield 502 and iris shield 414 (see FIG. 4). For simplicity in FIG. 5, only wedge-shaped shield 502 is depicted in relationship to wafer 412 from a bottom view on electrical pathway 410.

Wedge-shaped shield is formed as an isosceles triangle presenting an angle θ towards the central portion of wafer 412. A pair of stepper motor-driven screw assemblies 504 and 506 are actuated by controller 424 to impart X and Y motion to wedge-shaped shield 502. Thus, a relatively larger or relatively smaller surface area of wafer 412 is screened from the applied field by X-Y motion of wedge-shaped shield 502. A third stepper motor-screw assembly (not depicted in FIG. 4) may be provided to impart a Z range of motion in a third dimension.

Tilted Wedge Shaped Shield

Figure 6:
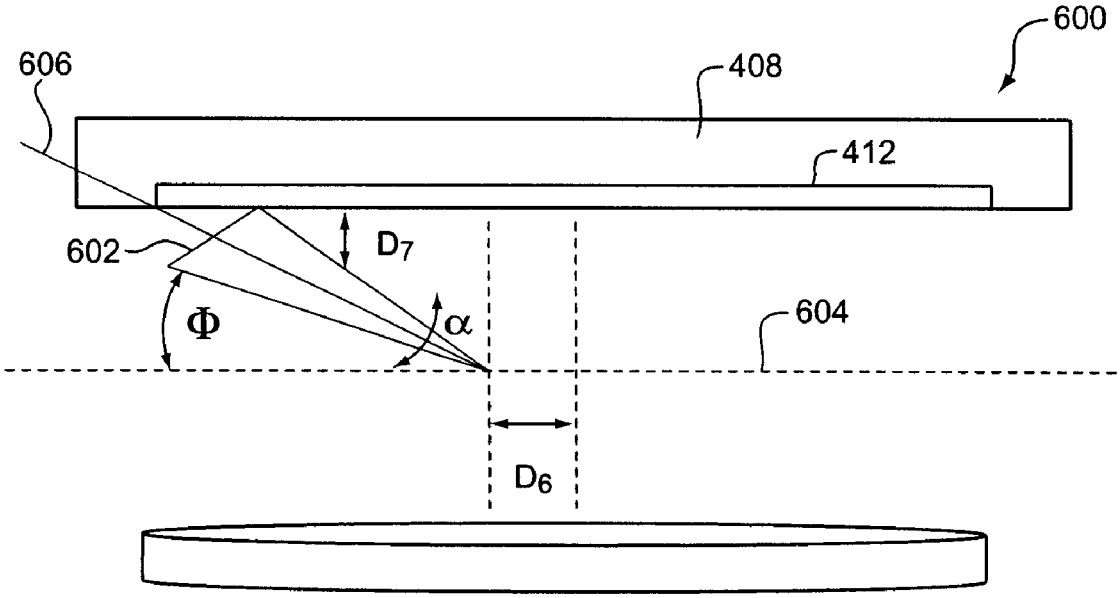
FIG. 6 depicts a second embodiment of an electrochemical reactor according to the present invention where the shield is constructed as a wedge that may be tilted and rotated.

FIG. 6 depicts a third embodiment of the invention including an electrochemical reactor 600 from a side elevational view. Electrochemical reactor 600 is identical to electrochemical reactor 400, except for differences between a wedge-shaped shield 602 and wedge-shaped shield 502. Wedge-shaped shield 602 differs from wedge-shaped shield 502 because wedge-shaped shield 602 is canted at an angle ϕ determined with respect to a line 602 running parallel to a chord taken across wafer 412. Wedge-shaped shield 602 may also be rotated at an angle a about an axis 604 to vary the surface area that is presented to wafer 412.

Semi-Iris Shield

Figure 7:
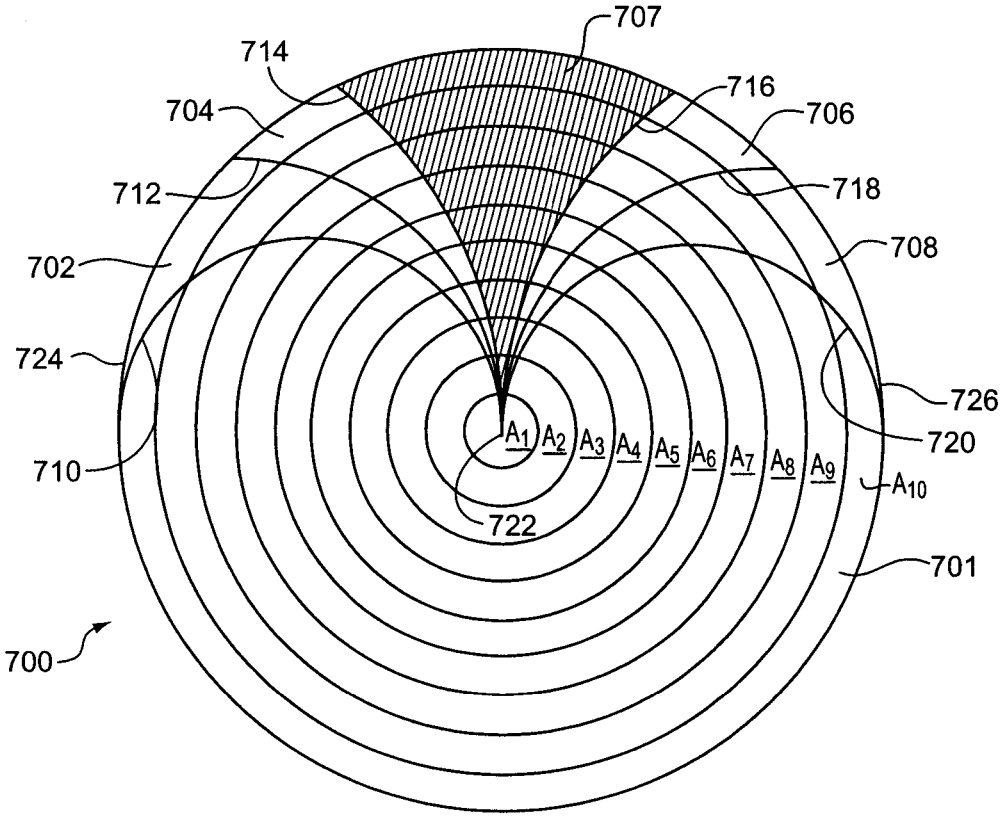
FIG. 7 depicts yet another electrochemical cell having a shield formed as a semi-iris or bat-wing configuration.

The shields may take on any shape including that of bars, circles, elipses and other geometric designs. FIG. 7 depicts an electrochemical reactor 700 that is identical to electrochemical reactor 400, except for differences between the shields. FIG. 7 is a bottom view of cell 700 including a wafer 701, which functions as the cell cathode and is masked with shields 702, 704, 706, 707 and 708 respectively having pairs of curved sides 710, 712, 714, 716, 718, and 720 extending from the center of the wafer 701 to the edges of the wafer 701. The curved sides 710 and 720 have a radius of curvature of about six inches. The curved sides 710 and 720 each have an inner end 722 that, as depicted, is aligned with the center of the wafer 701, but may be shifted in any radial or vertical direction, e.g., to radial distances $A_1$ through $A_{10}$. The outer ends 724 and 726 of the curved sides 710 and 720 are aligned with the radially outboard edge of wafer 701. The line connecting to the inner end 722 and the outer end 724 of the curved side 710 and the line connecting to the inner end 722 and the outer end 726 of the curved side 720 form an angle of about 180°.

The curved sides 712 and 718 have a radius of curvature of about 8.4 inches for a 200 mm wafer. The curved sides 712 and 718 have inner and outer ends similar to the inner and center ends of the curved sides 710 and 720 except that the lines connecting the inner end and the outer end of each curved side form an angle of about 90°. The curved sides 714 and 716 have a radius of curvature of about 14.4 inches. Similarly, for the curved sides 714 and 716, the lines connecting the inner end and the outer end of each curved side form an angle of about 60°. Shields having this type of shape are referred to herein as semi iris arc shields with curved sides.

Figure 8:
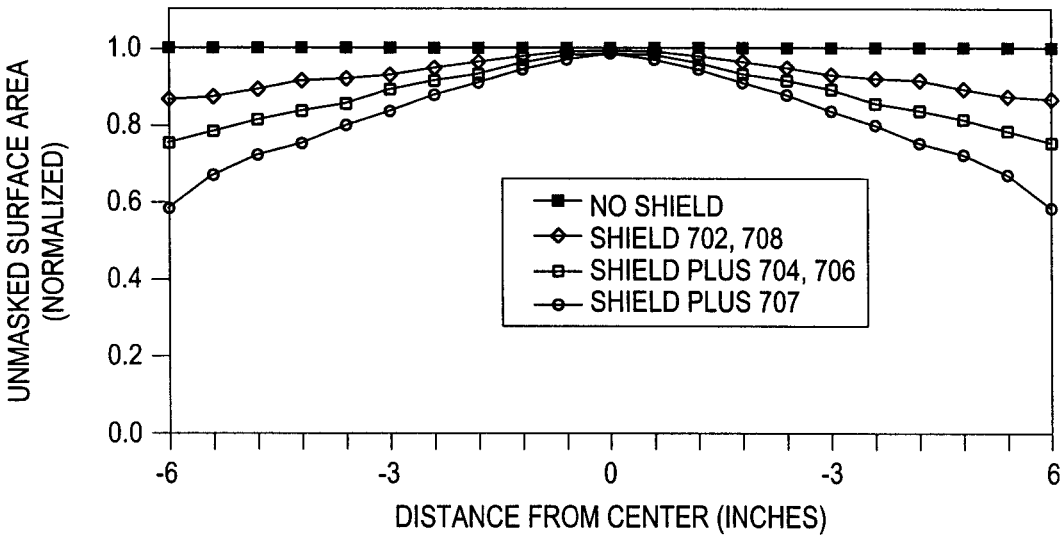
FIG. 8 is a plot of normalized area of a wafer covered by the shield shown in FIG. 7.

FIG. 8 depicts a plot of normalized unmasked surface area on wafer 701 with various shields installed including no shield; shields 702 and 708 in combination; shields 702, 708, 704 and 706 in combination; and shields 702, 708, 704, 706 and 707 in combination. The curves show that the percentage of masked surface area as a function of distance from the center of the wafer 701 has a parabolic shape, which can be selectively configured to compensate for nonlinear current drop in thin films on the face of wafer 701.

The shields that are shown and described in FIGS. 4–7 may be used alone or in combination. For example, multiple iris shields like shield 414 of FIG. 4 may be stacked in succession along electrical pathway 410, or shield 414 may be stacked in succession with shield 502 and shield 602.

Those skilled in the art will understand that the preferred embodiments described above may be subjected to apparent modifications without departing from the true scope and spirit of the invention. The inventors, accordingly, hereby state their intention to rely upon the Doctrine of Equivalents, in order to protect their full rights in the invention.

We claim:

1. An electrochemical reactor having a variable field-shaping capability for use in electroplating thin films, comprising:

a reservoir operably configured to retain an electrolytic fluid;

a cathode and an anode disposed in said reservoir to provide an electrical pathway through electrolytic fluid when said electrolytic fluid is present in said reservoir;

at least one of said cathode and said anode including a wafer-holder;

a shield positioned in said electrical pathway between said cathode and said anode and operably configured for shielding a surface area on a wafer in said wafer-holder when said wafer is held in said wafer-holder during electroplating operations, said shield including means, operable during electroplating operations, for selectively varying a parameter selected from the group consisting of a quantity of shielded surface area, a distance separating said shield from a wafer in said wafer holder, and combinations thereof.

2. The electrochemical reactor as set forth in claim 1 wherein said means for selectively varying a parameter includes a shield having an aperture and means for changing a size of said aperture.

3. The electrochemical reactor as set forth in claim 2 wherein said means for changing a size of said aperture includes a mechanical iris defining said aperture.

4. The electrochemical reactor as set forth in claim 2 wherein said means for changing a size of said aperture includes a strip having a plurality of different size openings.

5. The electrochemical reactor as set forth in claim 1 wherein said means for selectively varying a parameter includes means for shifting said shield along said electrical pathway to vary a distance separating said wafer holder and said shield.

6. The electrochemical reactor as set forth in claim 5 wherein said means for shifting said shield along said electrical pathway to vary a distance between said wafer holder and said shield includes a stepper motor-actuated screw assembly.

7. The electrochemical reactor as set forth in claim 1 including means for rotating said wafer holder.

8. The electrochemical reactor as set forth in claim 1 wherein said means for selectively varying a parameter includes a wedge shield.

9. The electrochemical reactor as set forth in claim 8 including means for varying a position of said wedge shield with respect to said wafer holder.

10. The electrochemical reactor as set forth in claim 9 wherein said means for varying a position of said wedge shield with respect to said wafer holder includes means for varying a coordinate selected from the group consisting of X coordinates, Y coordinates, Z coordinates, and combinations thereof.

11. The electrochemical reactor as set forth in claim 9 wherein said means for varying a position of said wedge shield with respect to said wafer holder includes means for varying an angle of said wedge shield relative to said wafer holder.

12. The electrochemical reactor as set forth in claim 1 including a computer operably configured to control operation of said means for selectively varying said parameter to provide a uniform deposition rate across a wafer in said wafer holder.

13. The electrochemical reactor as set forth in claim 12 wherein said computer is configured to actuate said means for selectively varying said parameter responsive to changes in current density at said wafer holder.

14. The electrochemical reactor as set forth in claim 13 wherein said computer is operably configured to actuate said means for selectively varying said parameter to provide a substantially constant current density across a wafer in said wafer holder.

15. A method of electroplating films for use in integrated circuits through an electrochemical reactor having a variable field-shaping capability, said method comprising the steps of:

placing a wafer in electrical contact with one of a cathode and an anode in an electrochemical reactor;

conducting electricity through an electrolytic fluid between said cathode and said anode for electroplating a film onto said wafer; and actuating a shield to vary an electric field around said wafer holder during electroplating operations, wherein said step of actuating a shield includes actuating said shield during electroplating operations to vary a parameter selected from the group consisting of a quantity of shielded surface area, a distance separating said means for selectively masking a surface area from a wafer in said wafer holder, and combinations thereof.

16. The method according to claim 15 wherein said shield has an aperture and said step of actuating said shield includes changing a size of said aperture to vary said quantity of shielded surface area.

17. The method according to claim 16 wherein a mechanical iris defines said aperture and said step of changing said size of said aperture includes actuating said mechanical iris.

18. The method according to claim 16 wherein said shield is a shiftable strip having a plurality of different size openings and said step of changing a size of said aperture includes shifting said strip relative to said wafer.

19. The method according to claim 15 wherein said step of actuating said shield includes shifting said shield to vary a distance between said wafer holder and said shield.

20. The method according to claim 15 including a step of rotating said wafer relative to said shield during electroplating operations.

21. The method according to claim 15 wherein said step of actuating said shield includes actuating a wedge shield.

22. The method according to claim 21 wherein said step of actuating said wedge shield includes varying a coordinate of said wedge shield selected form the group consisting of X coordinates, Y coordinates, Z coordinates, and combinations thereof, concomitant with rotation of said wafer.

23. The method according to claim 22 wherein said step of means varying a position of said wedge shield with respect to said wafer holder includes varying an angle of said wedge shield.

24. The method according to claim 15 wherein said step of actuating said shield is performed responsive to changes in current density at said wafer holder.

25. The method according to claim 24 wherein said step of actuating said shield is performed to provide a substantially constant current density at said wafer holder.

* * * * *

UNITED STATES PATENT AND TRADEMARK OFFICE

CERTIFICATE OF CORRECTION

PATENT NO. : 6,402,923 B1
DATED : June 11, 2002
INVENTOR(S) : Steven T. Mayer et al.

It is certified that error appears in the above-identified patent and that said Letters Patent is hereby corrected as shown below:

Title page,
Item [73], Assignee, please insert the following:

-- [73] Assignee: Novellus Systems, Inc., San Jose, Calif. --.

Signed and Sealed this

Tenth Day of September, 2002

*Attest:*

*Attesting Officer*

JAMES E. ROGAN
*Director of the United States Patent and Trademark Office*